US009200846B2

(12) United States Patent
Luettenberg

(10) Patent No.: US 9,200,846 B2
(45) Date of Patent: Dec. 1, 2015

(54) METHOD FOR OPENING AND CLOSING A TAPPING OPENING OF A METALLURGICAL SMELTING VESSEL AND METALLURGICAL SMELTING VESSEL

(71) Applicant: SMS Siemag AG, Duesseldorf (DE)

(72) Inventor: Mathias Luettenberg, Xanten (DE)

(73) Assignee: SMS GROUP GMBH, Duesseldorf (DE)

( * ) Notice: Subject to any disclaimer, the term of this patent is extended or adjusted under 35 U.S.C. 154(b) by 0 days.

(21) Appl. No.: 14/405,250

(22) PCT Filed: May 16, 2013

(86) PCT No.: PCT/EP2013/060120
§ 371 (c)(1),
(2) Date: Dec. 3, 2014

(87) PCT Pub. No.: WO2013/182395
PCT Pub. Date: Dec. 12, 2013

(65) Prior Publication Data

US 2015/0145184 A1 May 28, 2015

(30) Foreign Application Priority Data

Jun. 5, 2012 (DE) ..... 10 2012 209 504

(51) Int. Cl.

| | |
|---|---|
| ***B22D 41/00*** | (2006.01) |
| ***F27D 3/15*** | (2006.01) |
| ***C21C 5/46*** | (2006.01) |
| ***F27B 3/19*** | (2006.01) |
| *F27D 3/00* | (2006.01) |

(52) U.S. Cl.
CPC ..... *F27D 3/1509* (2013.01); *C21C 5/4653* (2013.01); *F27B 3/19* (2013.01); *F27D 3/1518* (2013.01); *F27D 3/1536* (2013.01); *F27D 2003/0057* (2013.01)

(58) Field of Classification Search
CPC ..... B22D 41/22; B22D 41/24; B22D 41/38
USPC ..... 222/600
See application file for complete search history.

(56) References Cited

U.S. PATENT DOCUMENTS

| | | | | |
|---|---|---|---|---|
| 4,623,130 | A * | 11/1986 | Bruckner et al. | 266/271 |
| 6,210,531 | B1 | 4/2001 | Bruckner et al. | |
| 2015/0145184 | A1* | 5/2015 | Luettenberg | |

FOREIGN PATENT DOCUMENTS

| | | | |
|---|---|---|---|
| DE | 3230646 | C1 | 10/1983 |
| EP | 624769 | A1 | 11/1994 |

(Continued)

*Primary Examiner* — Scott Kastler
(74) *Attorney, Agent, or Firm* — Abelman, Frayne & Schwab

(57) ABSTRACT

The invention relates to a method for opening and closing a tapping opening of a metallurgical smelting vessel in particular of an electric arc furnace, in the bottom region of which a wall section having an opening is arranged, wherein a device for moving block elements in a direction (T) perpendicular to the surface normal of the wall section in the area of the opening is arranged below the opening, wherein the device holds the block elements on the wall section in such a way that the block elements lie against the wall section in a sealing manner. In order to achieve wear free and reliable opening and closing of the tapping opening it is provided that, in order to close the tapping opening, a block element free of passage openings is moved under the opening by the device and that, in order to open the tapping opening, a block element having at least one passage opening is moved under the opening by the device, such that liquid metal an drain from the smelting vessel through the passage opening in the block element. The invention further relates to a metallurgical smelting vessel.

3 Claims, 4 Drawing Sheets

(56) References Cited

FOREIGN PATENT DOCUMENTS

Figure 1:
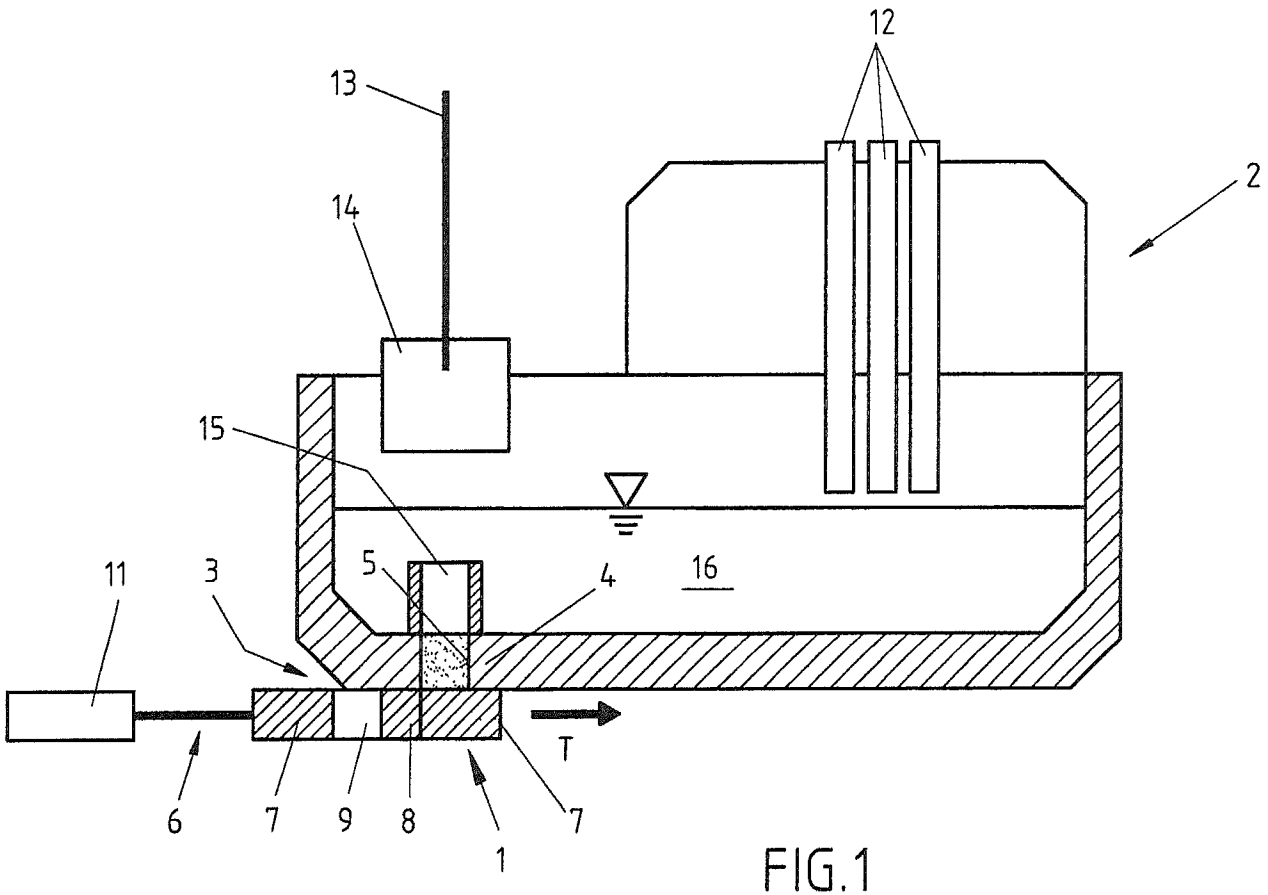

| | | | |
|---|---|---|---|
| EP | 1172162 | A1 | 1/2002 |
| EP | 1203920 | A1 | 5/2002 |
| JP | 10-286658 | A | 10/1998 |
| JP | 2000 033465 | A | 2/2000 |
| WO | 97 31736 | A1 | 9/1997 |
| WO | 98 15374 | A1 | 4/1998 |
| WO | 2005 024069 | A2 | 3/2005 |
| WO | 2011 009579 | A1 | 1/2011 |

* cited by examiner

METHOD FOR OPENING AND CLOSING A TAPPING OPENING OF A METALLURGICAL SMELTING VESSEL AND METALLURGICAL SMELTING VESSEL

The invention relates to a method of opening and closing a tapping opening of a metallurgical smelting vessel, in particular, of an electric arc furnace in a bottom region of which, a wall section with an opening is provided, wherein beneath the opening, there is provided a device for opening and closing the tapping opening. The invention further relates to a metallurgical smelting vessel.

The state-of-the art discloses the method to which the invention relates. WO2005/024069 A2 discloses a tapping device for a smelting vessel. A tapping channel is provided with a replaceable nozzle. The nozzle is positioned with a nozzle changer and is replaced after each or after two or more tappings by a new nozzle. This device is relatively expensive.

EP 1 172 162 A1 provides a solution according to which two, vertically arranged one above another linear slides are provided in the region of the tapping opening. By corresponding control of the slides, a pourable filling mass is brought in the intermediate space between the slides to close the tapping opening after tapping again.

A further solution is disclosed in WO 2011/009579 A1 which involves a sealing and filling tube, a vessel with a filling mass, an opening and closing device, and a lifting mechanism.

EP 0 624 769 B1, EP 1 203 920 A1 and DE 32 30 646 C1 disclose other specific solutions, in particular, for closing the tapping opening after tapping.

The drawback of all of the known solutions consists in that they involve very high costs, in term of their technology, in order to provide for continuity of the tapping process. The tapping opening and, in particular, nozzles which, if needed, are arranged therein are subjected to a relatively high wear, so that the tapping process varies, wear dependent on, with time. With so far available known replacement nozzles, the devices for placing the nozzles remain expensive.

Another problem consists in that a high degree of reliability need be insured, i.e., a perfect function of all components during tapping (reliability against non-controlled tapping).

Accordingly, an object of the invention is to provide a method of the above-described type as well as a smelting metallurgical vessel which would enable to carry out tapping reliably and cost-effectively. The to-be-used device should be simply formed. The same process conditions should be guaranteed for each tapping.

The tapping should be carried out in a reliable manner so that non-controlled tapping can be reliably prevented.

This object is achieved according to the invention with a method characterized in that there is provided beneath the opening of the wall section, a device for displacing block elements in a direction transverse to a surface normal of the wall section in a region of the opening, i.e., in tangential direction relative to the wall section or in the plane of the wall section, wherein the device so retains the block elements against the wall section that they sealingly abut the wall section, wherein for closing the tapping opening, the device pushes a block element free of passage openings under the opening, and wherein for opening the tapping opening, the device pushes a block element having at least one passage opening under the opening so that liquid metal can flow out of the smelting vessel through the passage opening in the block element.

Advantageously, the device pushes the block elements translationally in the direction transverse to the surface normal of the wall section in the region of the opening.

Advantageously, a new block element is used for each closing of the tapping opening. Correspondingly, a new block element can be used for each opening of the tapping opening.

Advantageously, the passage opening in the block element is at least partially filled with cover sand before placing the block element under the opening.

The proposed metallurgical smelting vessel is characterized in that the device has a guide for displacing block elements in a direction transverse to the surface normal of the wall section in the region of the opening, and at least one actuator for displacing the block elements.

Advantageously, the guide is formed for sealingly retaining the block elements against the wall section.

Preferably, the guide is a linear guide. However, it is conceivable to use an arcuate guide over which the block elements can be rotationally displaced.

Preferably, the actuator is formed as a hydraulic piston-cylinder unit.

Preferably, the block elements are formed as cuboids. Thus, according to the invention, there are provided replacement nozzles and closing blocks with which, the tapping opening can be automatically open and closed. Advantageously, the nozzles are not subjected to any wear that would have, with time, altered the tapping process. Further, a high degree of reliability is achieved.

Preferably, alumina or clay stoppers are used as plugging apparatuses for pouring-in the sliding cover sand.

The proposed features are preferably used in stationary smelting apparatuses. However, the use of the inventive features in non-stationary units is not excluded.

The preferred area of application of the invention is smelting units such as electric arc furnaces (EAF), submerged arc furnaces (SAF), so-called con-arc furnaces.

Figure 2:
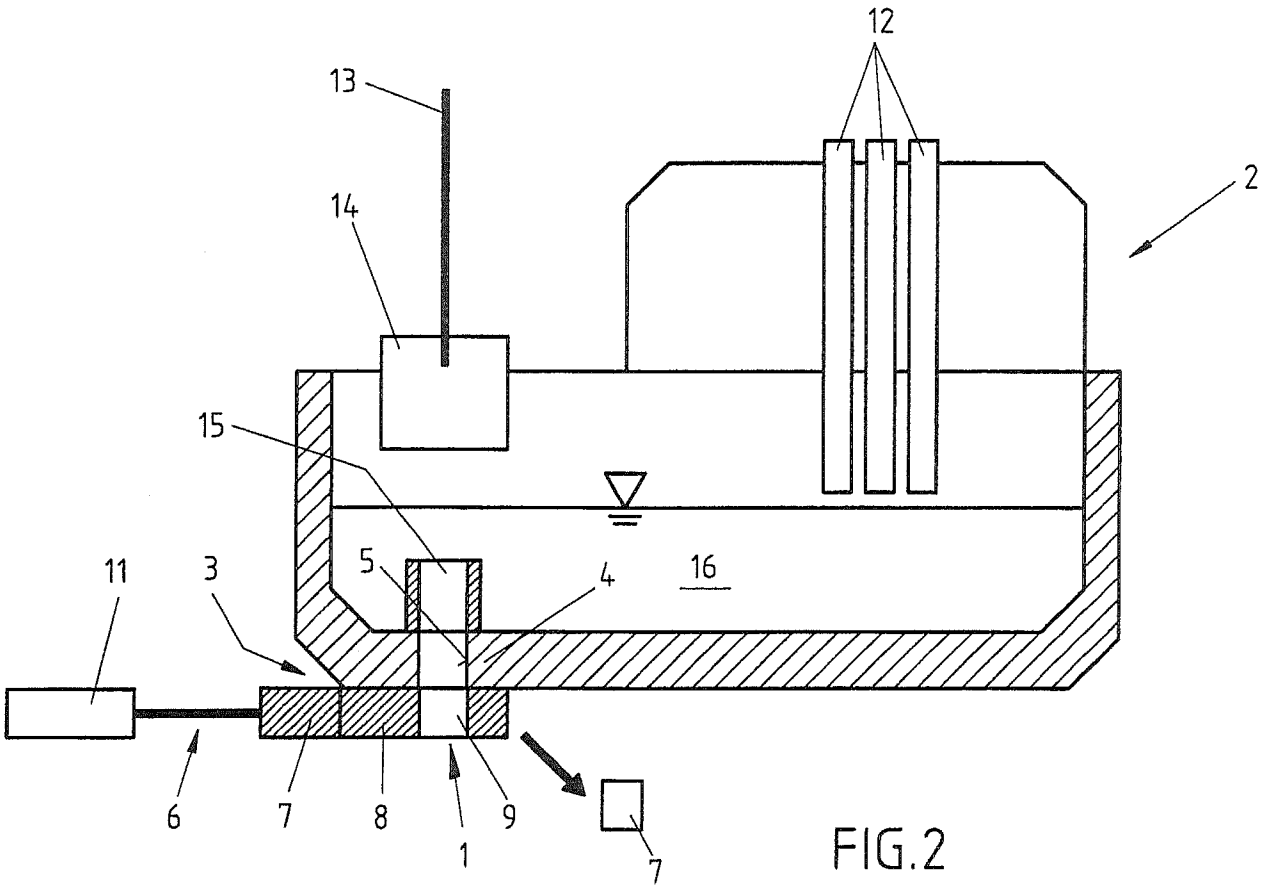
Figure 3:
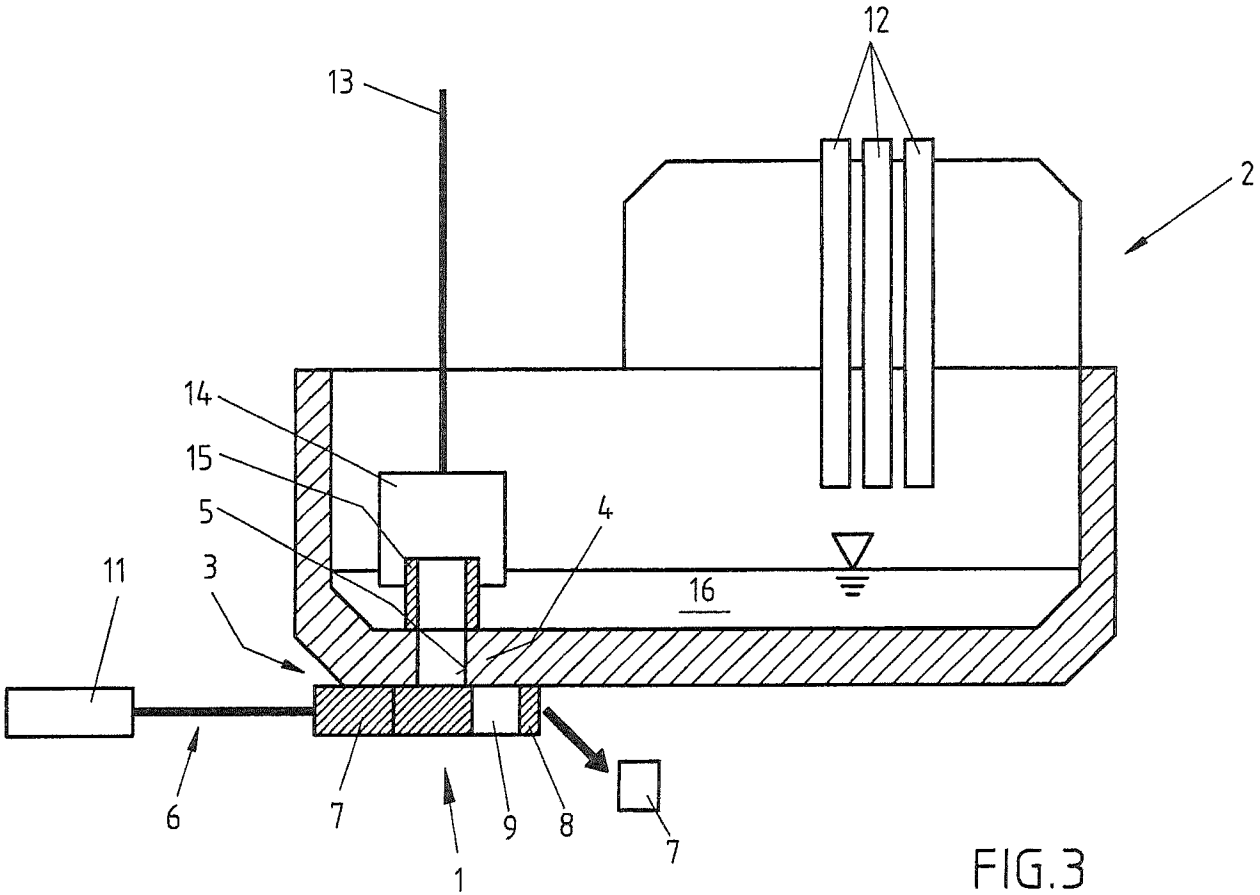
Figure 4:
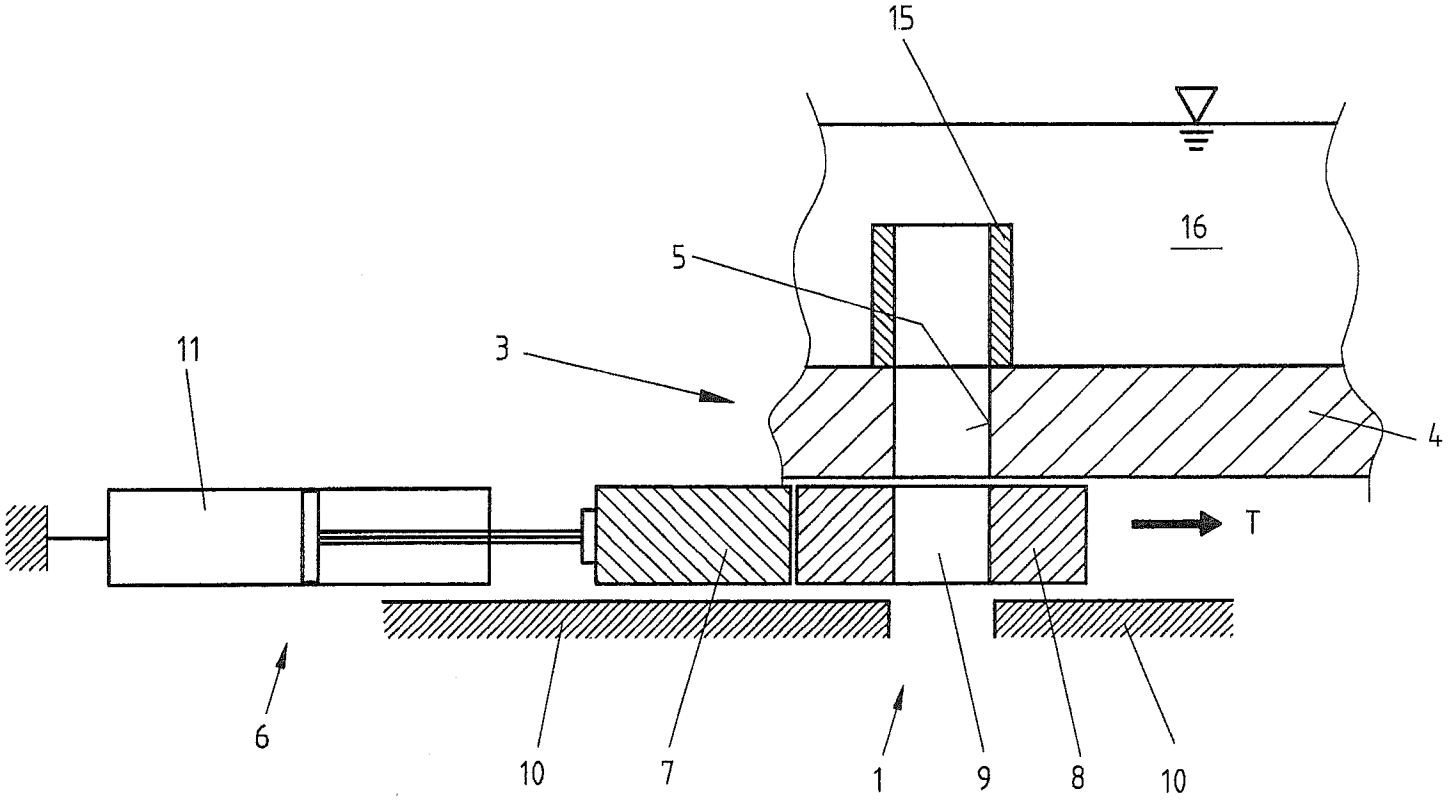

The drawings show an embodiment of the invention. In the drawings:

FIG. 1 a schematic side view of an electric arc furnace, wherein the tapping opening in the bottom of the furnace is closed;

FIG. 2 a schematic side view of the electric arc furnace according to FIG. 1, wherein the tapping opening is open for letting the melt out;

FIG. 3 a schematic side view of the electrical arc furnace according to FIG. 1, wherein the tapping opening is closed again; and FIG. 4 an increased view of the region of the tapping opening in the condition of FIG. 2, i.e., with the open tapping opening.

FIG. 1 schematically shows a metallurgical smelting vessel 2 in form of an electric arc furnace. Scrap is melted in the vessel 2, with energy being applied through electrodes 12. Thereby, melt 16 is formed that reaches a certain level.

The vessel has a wall with a bottom region 3 in which there is provided a tapping opening 1 through which melt 16 can flow out from the vessel 2. To this end, the tapping opening 1 is open and is closed again in a certain manner. In order to be able to reproduce this in a reliable manner, there is provided in a wall section 4 of the bottom region 3 an opening 5 that can be open or closed from beneath. To this end, there is provided a device 6 that will be described in detail below:

In order to be able to retain a certain residual sump in the vessel 2, a heat-resistant protection tube 15 is arranged above the opening 5. There is further provided a filing pipe 13 for sliding closure sand at the lower end of which, a bell for a slag-free tapping is provided.

Opening and closure of the opening 5 in the bottom region 3 of the vessel is carried out by using block elements 7 and which have a cuboid shape. The first block element 7 consists of a heat-resistant body free from any channels. The second block element 8 has a passage opening 9 that functions as an outlet nozzle for fluid metal.

The above-mentioned block elements 7, 8 are purposefully displaced by a device 6 in a direction T transverse to the surface normal of the wall section 4 in the region of the opening 5, i.e., the displacement takes place in a plane defined by the bottom side of the wall section 4. Thus, the displacement takes place along the surface of the wall section 4.

FIG. 1 shows that the block element 7 is displaced immediately under the opening 5 by an actuator 11 of the device 6 so that the vessel 2 becomes sealed and, as a result, no melt can exit. In the condition shown in FIG. 1, the scrap is melted in the vessel 2 and a certain level of the melt 16 is produced in the vessel 2. The opening 5 in the bottom region 3 at that is filled with the cover sand.

FIG. 2 shows that the vessel 2 is open at the bottom for tapping i.e., the opening 5 is freed so that the melt 16 can flow out from the vessel 2. To this end, the block element 8 with the passage opening 9 is pushed by the actuator 11 under the opening 5, so that the melt 16 can flow out from the vessel 2.

An arrow in FIG. 2 shows that the block element 7 which previously was put in, was displaced out, it is removed.

After a desired amount of melt is drained, the vessel 2 is closed again, as shown in FIG. 3. The actuator 11 displaces the next blocking element 7, which is again without the opening 9, under the opening 5, sealing the later. With the filling tube 13, again, the cover sand fills the opening 5 before the vessel 2 is charged anew.

In FIG. 3, an arrow again shows that the used block elements 7, 8, now the block element 8, is displaced out and is removed.

FIG. 4 show details for forming the device 6. As shown, the block elements 7, 8 are displaced in direction T on a (linear) guide 10, to this end, the piston-cylinder unit 11 is provided. At that, the block elements 7,8 must sealingly abut the bottom of the wall section 4 in order to prevent flow of the melt 16 out of the vessel 2. To this end, it can be provided, which is not shown here in detail, that the linear guide 10 applies an upwardly directed force to the block elements 7, 8 so that these elements neatly abut the bottom of the wall section 4.

The invention can be summarized or characterized as follows:

In the bottom region 3 of the smelting unit 2, there is provided, with a bow tapping system, a bottom sleeve (that has an opening 5) over a heat-resistant protection tube 15. Beneath the bottom sleeve, there is located a displacement system (device 6) with nozzle blocks 7 and 8. For opening the tap, a block 8 with a nozzle opening (passage opening) 9 is pushed under the bottom sleeve which is filled with cover sand by a plug 13.

After removal of the cover sand through the passage opening 9 in the block element (nozzle block) 9, the melt is tapped. Because of the protection tube 15 above the bottom sleeve, always, a residual sung remains in the vessel 2.

After tapping the melt, a massive block 7, without an opening, is placed beneath the bottom sleeve, and the sleeve is filled with cover sand with the filling tube 13. Immediately thereafter, the charging can begin for starting the smelting cycle.

LIST OF REFERENCES

1 Tapping Opening
2 Metallurgical smelting vessel (electric arc furnace)
3 Bottom region
4 Wall section
5 Opening
6 Device for displacing block elements
7 Block element (without passage opening)
8 Block element (with passage opening)
9 Passage opening
10 Guide
11 Actuator (piston-cylinder unit)
12 Electrodes
13 Filling tube for sliding cover sand
14 Bell for slag-free tapping
15 Protection tube
16 Melt
T Direction

The invention claimed is:

1. A method of opening and closing a tapping opening (5) of a metallurgical smelting vessel of an electric arc furnace in a bottom region (3) of which, a wall section (4) with an opening (5) is provided, wherein beneath the opening (5), there is provided a device (6) for displacing block elements (7, 8) in a direction transverse to a surface normal of the wall section (4) in a region of the opening (5), wherein the device (6) so retains the block elements (7, 8) against the wall section (4) that they sealingly abut the wall section (4), wherein for closing the tapping opening, the device (6) pushes a block element (7) free of passage openings under the opening (5), and wherein for opening the tapping opening (5), the device pushes a block element (8) having at least one passage opening (9) under the opening (5) so that liquid metal can flow out of the smelting vessel through the passage opening (9) in the block element (8), wherein a new block element (7) is used for each closing of the tapping opening, and wherein a new block element (8) is used for each opening of the tapping opening (1).

2. A method according to claim 1, characterized in that the device (6) pushes the block elements (7, 8) translationally in the direction (7) transverse to the surface normal of the wall section (4) in the region of the opening (5).

3. A method of opening and closing a tapping opening (5) of a metallurgical smelting vessel of an electric arc furnace in a bottom region (3) of which, a wall section (4) with an opening (5) is provided, wherein beneath the opening (5), there is provided a device (6) for displacing block elements (7, 8) in a direction transverse to a surface normal of the wall section (4) in a region of the opening (5), wherein the device (6) so retains the block elements (7, 8) against the wall section (4) that they sealingly abut the wall section (4), wherein for closing the tapping opening, the device (6) pushes a block element (7) free of passage openings under the opening (5), and wherein for opening the tapping opening (5), the device pushes a block element (8) having at least one passage opening (9) under the opening (5) so that liquid metal can flow out of the smelting vessel through the passage opening (9) in the block element (8), wherein a new block element (7) is used for each closing of the tapping opening, and wherein a new block element (8) is used for each opening of the tapping opening (1), and wherein the passage opening (9) in the block element (8) is at least partially filled with cover sand before placing under the opening.

* * * * *